US005969585A

United States Patent [19]

Nishiyama et al.

[11] Patent Number: 5,969,585

[45] **Date of Patent: *Oct. 19, 1999**

[54] METHOD OF MANUFACTURING A DIELECTRIC RESONATOR DEVICE WITH AN OPENING COVERED BY A PRINTED CIRCUIT BOARD AND A CONDUCTIVE PLATE CONTACTING THE PRINTED CIRCUIT BOARD

[75] Inventors: Taiyo Nishiyama, Takatsuki; Masamichi Andoh; Yutaka Motooka, both of Nagaokakyo, all of Japan

[73] Assignee: Murata Manufacturing Co., Ltd., Japan

[ * ] Notice: This patent is subject to a terminal disclaimer.

[21] Appl. No.: 09/183,462

[22] Filed: Oct. 30, 1998

Related U.S. Application Data

[62] Division of application No. 08/804,914, Feb. 25, 1997, Pat. No. 5,874,870, which is a continuation of application No. 08/575,996, Dec. 21, 1995, Pat. No. 5,680,080.

[30] Foreign Application Priority Data

Dec. 26, 1994 [JP] Japan ..... 6-322106

[51] Int. Cl.[6] ..... H01P 7/10

[52] U.S. Cl. ..... 333/202; 333/219.1

[58] Field of Search ..... 333/202, 206, 333/208, 219, 219.1, 209, 235

[56] References Cited

U.S. PATENT DOCUMENTS 4,839,773 6/1989 Ishikawa et al. ..... 333/202

5,680,080 10/1997 Nishiyama et al. ..... 333/202

5,874,870 2/1999 Nishiyama et al. ..... 333/202

FOREIGN PATENT DOCUMENTS 6-338713 12/1994 Japan ..... 333/219.1

*Primary Examiner*—Seungsook Ham

*Attorney, Agent, or Firm*—Ostrolenk, Faber, Gerb & Soffen, LLP

[57] ABSTRACT

A dielectric resonance device includes at least one dielectric resonator having a hollow frame body often called the "cavity" in the art, cross-coupled dielectric pillars in the frame body, and an earth conductor on the outer surface of the frame body. The frame body has a pair of opposed openings at opposite ends thereof. A plurality of conductive plates are provided each of which has a first end coupled to the earth conductor and a second end. Two printed circuit boards acting as front and rear panel plates are attached to cover the openings, respectively. The second ends of the conductive plates are coupled by soldering to metal films of the first and second printed circuit boards while having the conductive plates folded to be in area-contact with and electrically connected to the printed circuit boards so as to tightly hold these boards. The dielectric resonator is held in a casing together with the conductive plates and the first and second printed circuit boards. An input/output connector is fixedly attached to the casing. This connector has a conductive portion being electrically connected to one of the first and second printed circuit boards.

11 Claims, 7 Drawing Sheets

FIG. 2
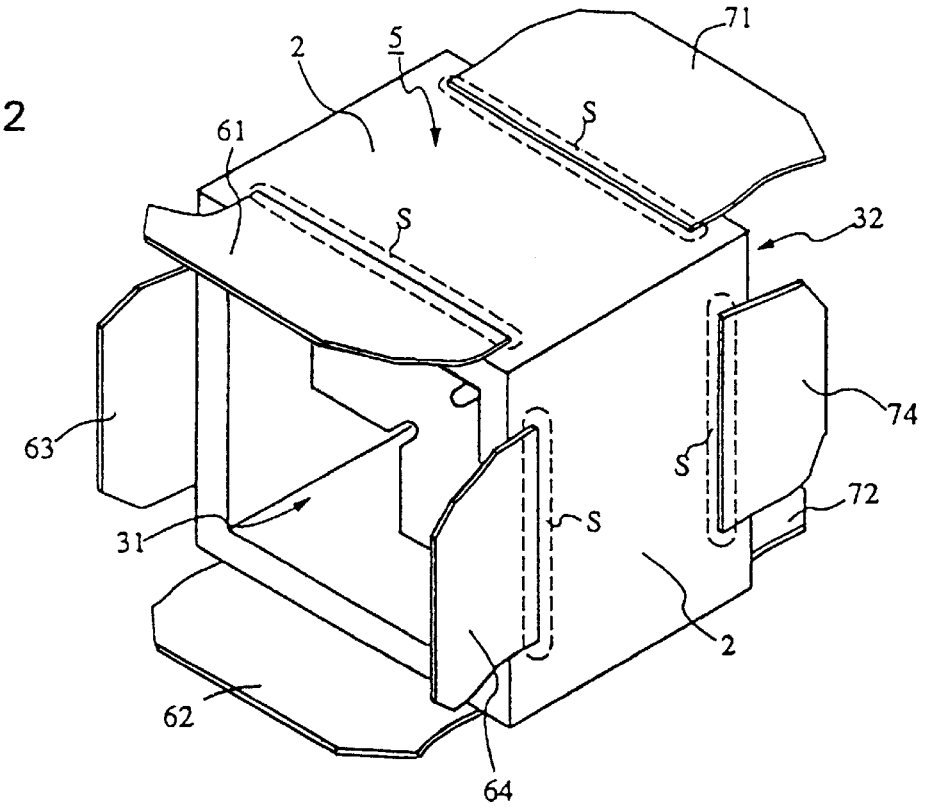
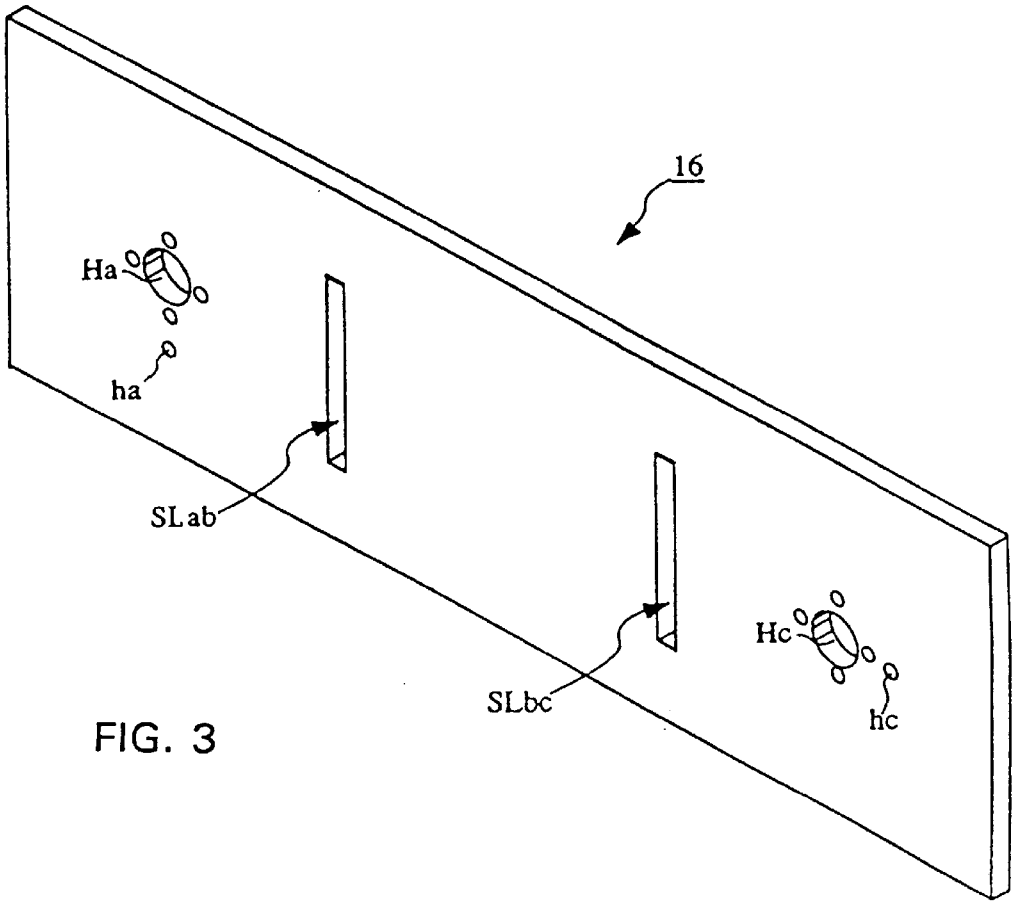
FIG. 3

METHOD OF MANUFACTURING A DIELECTRIC RESONATOR DEVICE WITH AN OPENING COVERED BY A PRINTED CIRCUIT BOARD AND A CONDUCTIVE PLATE CONTACTING THE PRINTED CIRCUIT BOARD

This is a division of application Ser. No. 08/804,914 filed Feb. 25, 1997, now U.S. Pat. No. 5,874,870, which is a continuation of application Ser. No. 08/575,996 filed Dec. 21, 1995, now U.S. Pat. No. 5,680,080.

BACKGROUND OF THE INVENTION

1. Field of the Invention

The present invention relates generally to dielectric resonators and more particularly to dielectric resonance device including one or a plurality of dielectric resonators each having a hollow frame body with an internal dielectric material disposed therein and a conductive material on the outer surfaces thereof.

2. Description of the Prior Art

In the prior art, TM-mode dielectric resonators are typically arranged to have a hollow frame body, sometimes called the "cavity" in the art, with an internally disposed dielectric material and a conductive material acting as an earth conductor disposed on the outer surfaces of the frame body. To provide easy assembly, these components are arranged in such a manner that the frame body consists of a rectangular cylindrical member having two openings at the opposite ends thereof with the dielectric material being disposed therein, and four outer surfaces (i.e., the top, bottom and two side wall surfaces) on which conductive layers are formed as the earth conductor. The inner dielectric material is comprised of a cross-coupled pillar member having two pillars, one of which extends horizontally to be coupled with two opposed inner surfaces of the side walls of frame body and the other of which extends vertically to be coupled with the other two opposed, top and bottom inner surfaces of the same.

In the manufacture of a multiple-stage dielectric resonance device including an array of dielectric resonators which are sequentially coupled to one another to provide a desired filter function, two adjacent ones of the resonators are disposed so that corresponding openings of the resonators face each other, and a conductive earth plate is attached by soldering to neighboring outer conductors on the outer surfaces of the resonators, thus causing the two adjacent resonators to be fixedly coupled to each other. Such resonator structure has been disclosed, for example, in Japanese Utility-Model Application No. 1-172702.

Unfortunately, such a conventional "conductor-soldering" resonator structure suffers from a problem in that an increased amount of heat may be generated at or in the vicinity of the soldered portions of neighboring dielectric resonators. In addition, soldering is a labor intensive and time consuming process, which causes the manufacturing process to decrease in efficiency while letting it become somewhat dangerous to factory workers.

The reasons for this will be described with reference to FIG. 8. In FIG. 8, there is illustrated in cross-section a prior art dielectric resonator structure, which employs a metal panel that is fixed to one opening of a resonator frame body in the case where two neighboring dielectric resonators are coupled together by soldering a conductive plate at its opposite ends to respective outer conductors of the resonators. As shown in FIG. 8, the frame body has a cross-coupled dielectric pillar member 4 integrally disposed in the inner space thereof. The frame body also has conductive layers 2 acting as the earth conductors which are formed on respective outer surfaces of the frame body. The frame body has a pair of openings at its opposite ends, at which openings two metal panels 8, 9 are disposed. These metal panels are coupled to the frame body using relatively thin conductive plates 6 by soldering each conductive plate 6 at its respective ends to the outer conductor 2 and to one edge of a corresponding metal panel 8 (or 9) opposed thereto. One of the metal panels, i.e., the front panel 8 in this case, has a hole for attachment of a known input/output connector 10 on it while a coupling loop 11 is used for electrically coupling the coupling loop 11 with the front panel 8. The whole structure is packed into a casing 12.

In the prior art resonator structure of FIG. 8, since the metal panels 8, 9 are designed to function also as a part of the casing 12, it is required that these panels be thick enough to provide a certain physical strength as required for the casing 12. In particular, when the input/output connector 10 is attached to and mounted on the metal panel 8, this panel 8 is required to be tough or stiff enough to fixedly hold the input/output connector 10 thereon; otherwise, when the connector 10 is twisted manually by a user, the panel 8 may possibly change shape causing the dielectric resonator to vary in its electric characteristics. To attain such stiffness, the metal panel should be thicker accordingly. However, as the panel thickness increases, the occurrence of heat diffusion becomes more severe during the soldering process at or in the vicinity of soldering portions of the resonator structure. This brings a more serious problem in that when an array of dielectric resonators are combined together into one integral form using a large-size metal panel, not only the resonators but also the metal panel must be preheated using an oven before the execution of the soldering process. This requires labor-intensive manufacturing steps at high temperatures which causes productivity to decrease. Moreover, such a process is dangerous to factory workers.

SUMMARY OF THE INVENTION

It is therefore an object of the present invention to provide a new and improved dielectric resonator structure.

It is another object of the invention to provide an improved dielectric resonance device which can be easily manufactured by employing a more effective process for assembly of its components, while the reliability and stiffness of the mechanical and electrical connections between the components are also enhanced.

It is a further object of the invention to provide an improved dielectric resonance device including an array of dielectric resonators combined together into a single rigid assembly structure.

It is yet another object of the invention to provide an improved dielectric resonance device which can exhibit enhanced physical strength and stability upon the application of bending stresses and torsion stresses to input/output connectors.

The instant invention provides a dielectric resonance device which includes at least one dielectric resonator having a hollow frame body, a dielectric material in the frame body, and a conductor on the outer surface of the frame body. The frame body defines a pair of opposed openings at opposite ends thereof. A plurality of conductive plates are provided each of which has a first end coupled to the conductor and a second end. Two printed circuit boards serving as front and rear panel plates are disposed to cover the openings, respectively. The second ends of the conductive plates are coupled by thermal bonding techniques to the printed circuit boards while allowing the conductive plates to be folded to contact respective areas on the printed circuit boards. The dielectric resonator is held in a casing structure together with the conductive plates and the first and second printed circuit boards. An input/output connector is fixedly attached to the casing structure. This connector has a conductive portion being electrically connected to one of the first and second printed circuit boards.

In accordance with one preferred embodiment of the invention, the front and rear printed circuit boards are directly fixed to the frame body of the dielectric resonator such that some of the conductive plates are folded at the peripheral edges of each printed circuit board to hold it with compressive pressures while providing electrical connections therebetween. In this case, each board includes an insulative substrate and a metal film for providing a required circuit pattern on the substrate. The casing is comprised of a rectangular cylindrical member having an elongate gap along the length thereof, for allowing the input/output connector to slide through the gap when the dielectric resonator is inserted into the cylindrical member for assembly. After insertion, the input/output connector is mounted on and fixed by screws to the front printed circuit board with its flange section being sandwiched between the casing and the printed circuit board.

In accordance with another embodiment of the invention, each of the front and rear printed circuit boards is comprised of a metal-based printed circuit board having a metal base plate and a metal film disposed above the base plate with an insulative layer being sandwiched therebetween. In this case, the casing advantageously includes two separate tray-like plates each having upstanding portions at both side edges thereof. These tray-like plates serve as the top and bottom casing plates, and are tightly coupled by screws with the front and rear metal-based printed circuit boards at their side portions, thereby to provide a rectangular cylindrical casing structure for packing the dielectric resonator therein. The input/output connector is directly mounted by screws on the front board.

In both embodiments, elastic spacers or dampers may be disposed in a narrow space defined between the inner surface of the casing and the outer surface of the dielectric resonator packed therein.

These and other objects, features and advantages of the invention will be apparent from the following more particular description of preferred embodiments of the invention, as illustrated in the accompanying drawings.

BRIEF DESCRIPTION OF THE DRAWINGS

FIG. 2 is a perspective view of an assembly structure of the resonator of FIG. 1 together with a plurality of conductive plates attached thereto.

FIG. 3 is a perspective view of a printed circuit board preferably employed for the formation of a dielectric resonance device including an array of dielectric resonators each having the structure shown in FIG. 1.

DETAILED DESCRIPTION OF EMBODIMENTS OF THE INVENTION

Figure 1:
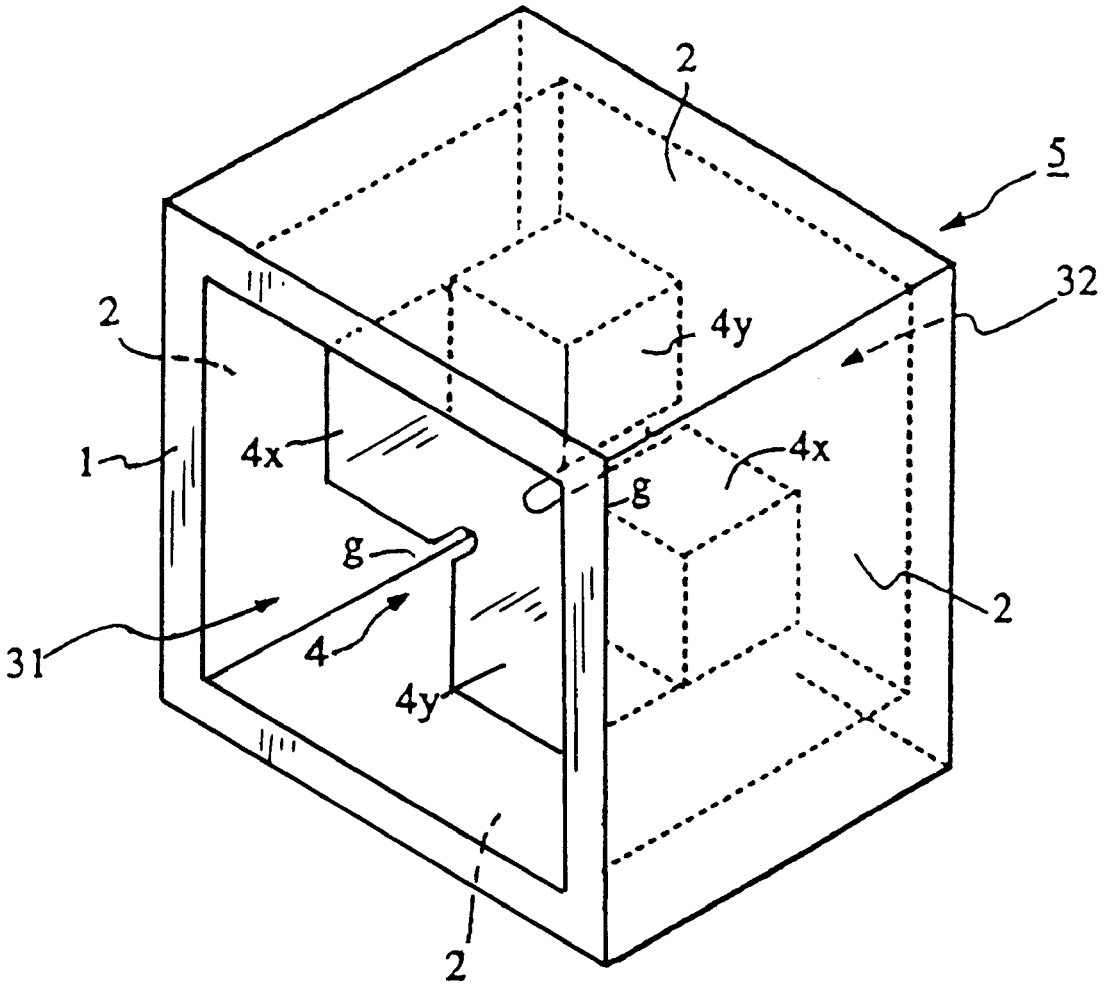
FIG. 1 is a perspective view of a dielectric resonator in accordance with one preferred embodiment of the invention.

Referring to FIG. 1, a dielectric resonance device embodying the present invention is shown wherein a dielectric resonator 5 includes a rectangular cylindrical frame body 1 having two square openings 31, 32 at its opposite ends. The frame body 1 may sometimes be called the "cavity" in the art. The frame body 1 has two pairs of opposed outer peripheral surfaces, i.e., a pair of top and bottom surfaces and another pair of right and left side surfaces. The frame body 1 also has a conductive layer 2 and a dielectric material 4. The conductor 2 acts as an earth conductor and is formed on the outer surfaces of the frame body 1. The dielectric material 4 may comprise a pair of integrally cross-coupled pillar-like members 4*x*, 4*y*, one (4*x*) of which extends horizontally to be coupled to the inner surfaces of the opposed left and right "walls" of the frame body 1, and the other (4*y*) of which extends vertically to be coupled to the inner surfaces of its "ceiling" and "floor". These members 4*x*, 4*y* are formed by well-known molding techniques to be integral with the frame body 1. The cross-coupled dielectric pillars 4*x*, 4*y* have grooves g, g at diagonally opposed corner lines of their crossing section, thereby allowing two resonator portions defined by the dielectric pillars 4*x*, 4*y* to be coupled together while causing odd- and even-oscillation modes generated by the pillars 4*x*, 4*y* to differ from each other in resonance frequency. This enables the dielectric resonator 5 to function as a two-stage resonator.

As will be described in detail later in the description of the specification, an array of three dielectric resonators each having the structure of FIG. 1 are sequentially coupled together to provide a six-stage dielectric resonance device, which acts as a band-pass filter. In the manufacture of such device, coupling of adjacent ones of the dielectric resonators is carried out by making use of one or more windows for magnetic coupling, which may be formed by cutting off parts of the conductors 2. Note here that a description of well-known arrangements for resonance-frequency adjustments and for coupling-coefficient adjustments between neighboring resonators is omitted from the illustration of FIG. 1 for purposes of simplicity only.

Turning now to FIG. 2, there is shown a structure wherein a plurality of conductive plates are attached to the dielectric resonator of FIG. 1. More specifically, eight conductive plates 61–64 and 71–74 (one plate 73 making a pair with plate 74 is not visible due to illustrative limitations only) are attached to respective opening edges of the frame body 1 in such a manner that a first group of conductive plates 61–64 are adhered at first ends to four edge portions of the earth conductors 2 associated with the "front" opening of the frame body 1, whereas a second group of conductive plates 71–74 are fixed at first ends to four edge portions of earth conductors 2 associated with the "rear" opening of the frame body 1, wherein second ends of these plates remain free. Known soldering processes or baking techniques may be used to attain such adhesion.

During the soldering process, it is required that the frame body 1 be preheated if it is large in thermal capacity; even in such a case, the manufacturing process can still be easier than that required in the case of heating the entire structure of an assembly of the dielectric resonators and the large-size metal panels in the prior art described in the introductory part of the description, due to the fact that the heating is needed merely for a dielectric resonator unit. In the embodiment, the conductive plates 61–64, 71–74 may be made of metallic thin films capable of being soldered easily, such as copper films, for example. These plates may alternatively be made of copper thin films having additional electroplated films, such as silver, on the surfaces thereof to suppress or prevent the occurrence of corrosion. Alternatively, the plates may also be made of mesh-shaped conductive plates in place of such metal thin films. Additionally, a plurality of slit holes for enhancing the soldering characteristics may be formed near the soldering portions of such conductive plates of the dielectric resonator. Attention should be directed to the fact that the components 61–64, 71–74 under the name of "conductive plates" may cover in meaning any types of conductive, deformable plate- or sheet-like members including those metal thin films having slit holes or mesh patterns.

FIG. 3 depicts a printed circuit (PC) board 16 which is preferably used to assemble an array of three dielectric resonators of this embodiment. The PC board 16 is employed as a "front" panel plate for the array of three dielectric resonators. The PC board 16 may be a glass-epoxy substrate having a copper film laminated thereon. The PC board 16 has several holes or openings, including circular holes Ha, Hc, small holes ha, hc around the holes Ha, Hb, and slits SLab, SLbc. The holes Ha, Hc are for attachment of input/output connectors, while the small holes ha, hc are for soldering of coupling loops to selected portions of the metal thin film of the PC board 16 after having one end of each coupling loop passed through a corresponding one of the small holes ha, hc associated therewith at a specific position where no metal thin-film portions are present. The slits SLab, SLbc are for allowing selected ones (63, 64) of the first group of conductive plates of FIG. 2 to pass through and be folded for fixed attachment of the PC board 16 to the array of dielectric resonators.

Figure 4:
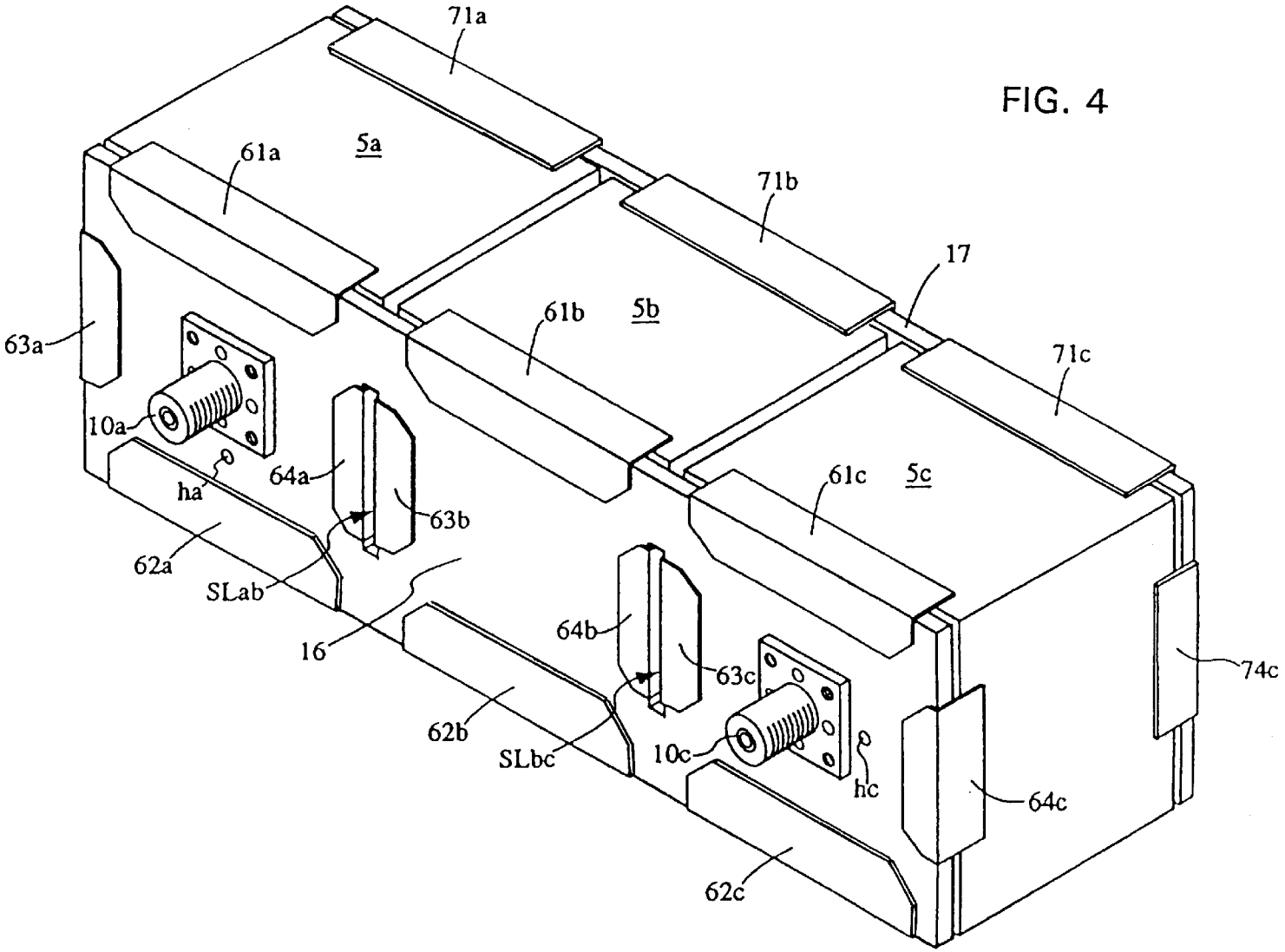
FIG. 4 is a perspective view of a dielectric resonance device including three sequentially-arrayed dielectric resonators with two printed circuit boards being attached on the opposed openings thereof by the use of a number of conductive plates.

Another PC board, which serves as the "rear" panel plate 17 in FIG. 4, is similar to that of FIG. 3 with the holes Ha, Hc, ha, hc and the slits SLab, SLbc being omitted.

FIG. 4 shows the entire structure of an array of dielectric resonators tightly combined together into an integral assembly by the use of the front and rear PC boards 16, 17 and the conductive plates 61–64, 71–74 folded for fixation. This assembly employs three identical dielectric resonators 5*a*, 5*b*, 5*c* which are linearly aligned such that their front square openings ("31" of FIGS. 1 and 2) define a plane with the front PC board 16 being attached thereto, and such that the rear PC board 17 is attached to the rear square openings ("32" of FIGS. 1 and 2) of the dielectric resonators 5*a*, 5*b*, 5*c* which are aligned to form another plane.

Such elongate dielectric resonator structure is rigidly assembled by the first and second groups of conductive plates 61–64 and 71–74 by folding the first plates 61–64, including plates 61*a*–64*a* for the dielectric resonator 5*a*, plates 61*b*–64*b* for resonator 5*b*, and plates 61*c*–64*c* for resonator 5*c*, are folded to fix the front PC board 16 to the front openings 31, whereas the second plates 71–74, including plates 71*a*–74*a* for the dielectric resonator 5*a*, plates 71*b*–74*b* for resonator 5*b*, and plates 71*c*–74*c* for resonator 5*c*, are folded to fix the rear PC board 17 to the rear openings 32 of the resonators 5*a*–5*c*. Note here that the front and rear PC boards 16, 17 are fixedly attached to the opposed openings 31, 32 respectively with the metal thin films of the PC boards facing outward.

Folding of the conductive plates 61–64, 71–74 is as follows. The upper and lower conductive plates 61*a*, 62*a* (61*b*, 62*b*; 61*c*, 62*c*) of one dielectric resonator 5*a* (5*b*; 5*c*) are simply folded at the upper and lower peripheral edges of the front PC board 16 to hold the outer surface of the PC board thereunder; the same goes for the upper and lower conductive plates 71*a*, 72*a* (71*b*, 72*b*; 71*c*, 72*c*) for holding the rear PC board 17. The side plates 63*a*, 64*c* of the resonators 5*a*, 5*c*, which plates are spaced apart from each other at the two ends of the elongate dielectric resonator structure of FIG. 4, are horizontally folded to tightly hold the opposed short edges of the front PC board 16; the same goes for the corresponding plates 73*a*, 74*c* (73*a* is not visible) for attachment of the rear PC board 17. Two side plates 63*b*, 64*b* of the intermediate dielectric resonator 5*b* are folded through the slits SLab, SLbc of the front PC board 16 together with adjacent ones 64*a*, 63*c* of the remaining dielectric resonators 5*a*, 5*c*; the same goes for those for the rear PC board 17.

After having all the plates 61–64, 71–74 (i.e., 61*a*–64*a*, 61*b*–64*b*, 61*c*–64*c*, 61*d*–64*d*, 71*a*–74*a*, 71*b*–74*b*, 71*c*–74*c*, 71*d*–74*d*) folded for fixation, soldering is then carried out causing respective plates 61–64, 71–74 to be adhered to the front and rear PC boards 16, 17. Note that, under such condition, input/output connectors 10*a*, 10*c* have been already mounted on the front PC board 16 at its circular holes Ha, Hc of FIG. 3 by fixing their respective flange sections behind the board 16 by the use of screws penetrating corresponding holes of the flange sections. Note also that known coupling loops (not shown in FIG. 4) have been added to the front PC board 16 thus providing electrical connections between the board 16 and respective central conductors of the input/output connectors 10*a*, 10*c*; more specifically, each coupling loop is soldered at its one end to the central conductor of a corresponding one of the input/output connectors 10*a*, 10*c* associated therewith, and is also soldered at the other end thereof to the front PC board 16 after having the other end passed through one of the small holes ha, hc from the back side of board 16 to project externally from its outer surface.

Figure 5:
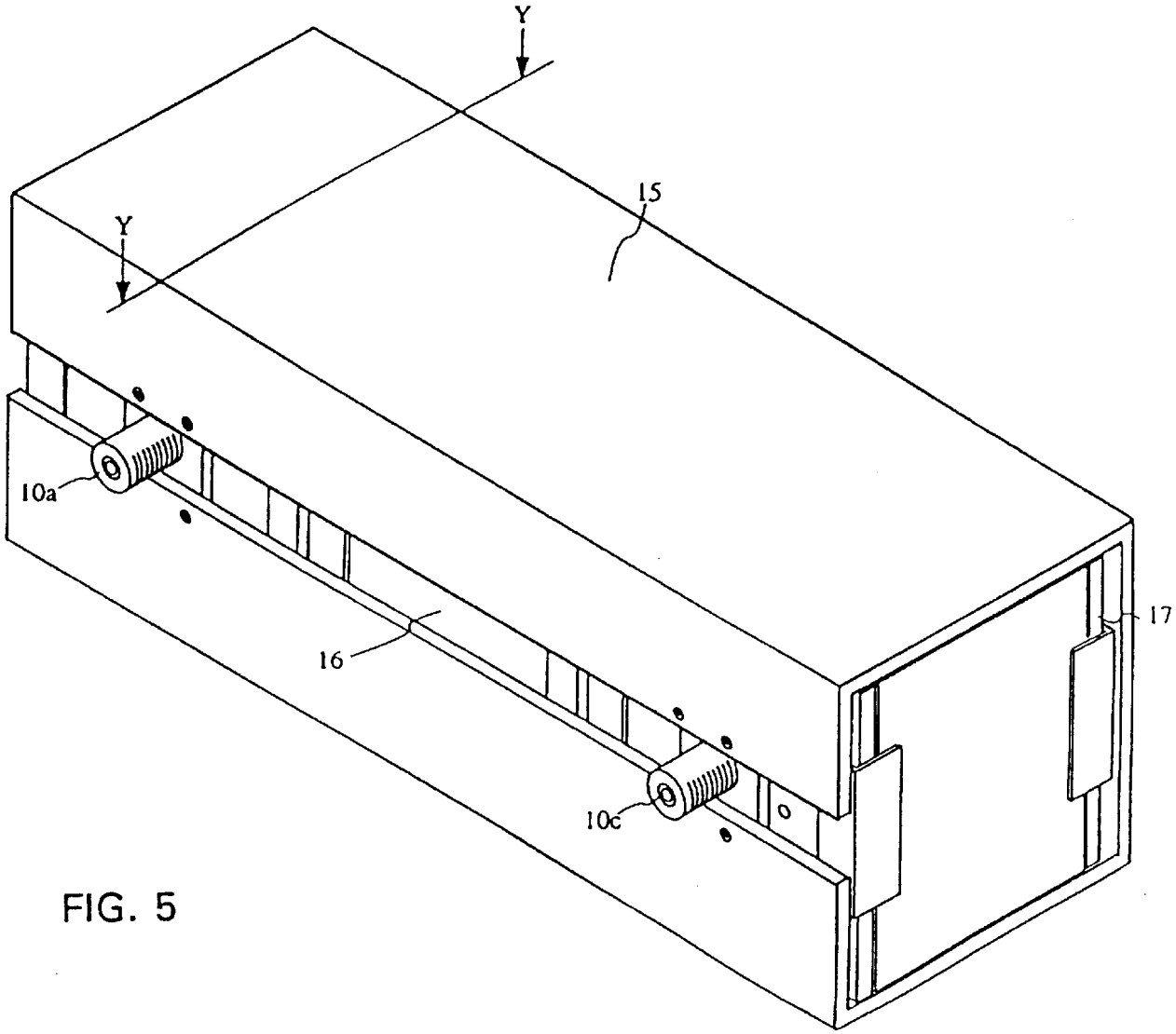
FIG. 5 is a perspective view of the final form of the entire structure of the dielectric resonance device of the invention.

As shown in FIG. 5, the resulting elongate dielectric resonator assembly of FIG. 4 is then packed in a casing 15, which is a rectangular cylindrical member or pipe made of a chosen metal. The pipe-like casing 15 has a longitudinal gap in one side surface thereof. This gap has substantially the same height as the input/output connectors 10*a*, 10*c*; the height of such gap is substantially equivalent to or slightly greater than the outer diameter of the connectors, thus enabling these connectors to move smoothly along the gap when the assembly of FIG. 4 is inserted into the inner space of the casing 15 from one of its end openings. After the insertion and precise position-adjustment, the casing 15 is then fixed by screws to the flange sections of the input/output connectors 10*a*, 10*c* with the screws penetrating holes located on both sides of the casing gap.

Figure 6:
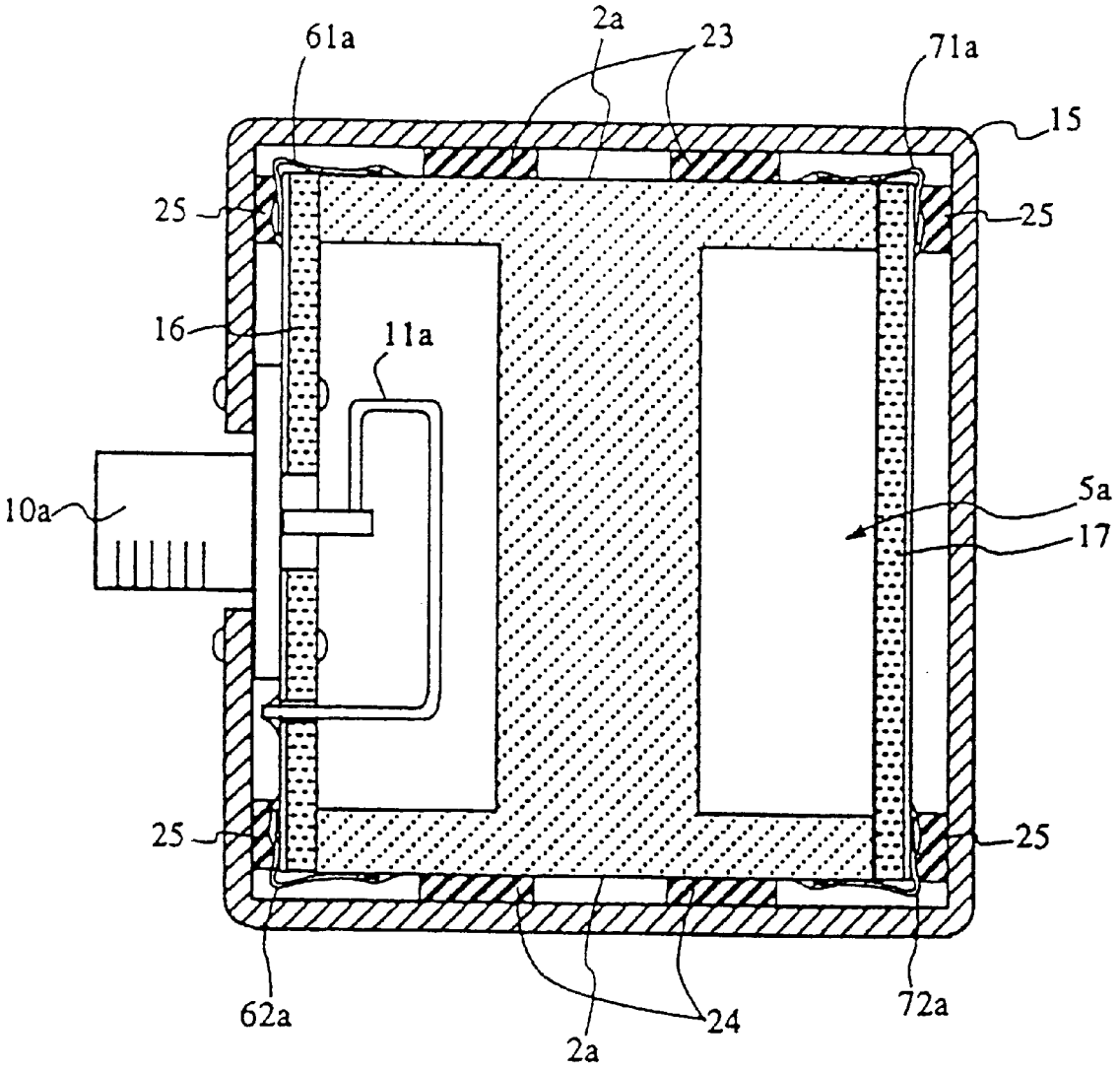
FIG. 6 is a cross-sectional view of the dielectric resonance device taken along a line Y—Y of FIG. 5.

A cross-section of the resultant structure along a line Y—Y of FIG. 5 is illustrated in FIG. 6. It is apparent from viewing the illustration of FIG. 6 that the input/output connector 10*a* is electrically connected at its outer conductor to the metal thin film of the front PC board 16 by fixing this board 16 by screws to the back side of the flange section of the input/output connector 10*a*, which section is in turn fixed by screws to the inner surface of the casing 15 having the longitudinal gap. One of the coupling loops mentioned earlier is visible and is designated by the numeral 11*a*. This loop 11*a* has one end soldered to the central conductor of the input/output connector 10*a* and the other end soldered to the metal thin film of the PC board 16.

Several elastic spacers or dampers 23, 24, 25, which are made of silicon rubber, for example, are disposed between narrow spaces as defined between the outer surfaces of dielectric resonator 5*a* and the inner surfaces of casing 15 opposed thereto, thus providing elastic support or suspension for them. Of these dampers, certain ones 25 are arranged at specific positions excluding the layout positions of the conductive plates 61*a*, 62*a*, 71*a*, 72*a* or others; more specifically, dampers 25 are at four corners of each of the front and rear openings 31, 32 (see FIG. 2) of the dielectric resonator 5*a*. Additionally, the formation of the dampers 23, 24, 25 may be done by using one of the following techniques: (1) adhering these dampers in advance to the outer surfaces of the elongate dielectric resonator assembly of FIG. 4 before the insertion of it into the casing 15, (2) depositing a cold curable silicon rubber layer on the outer surfaces of the assembly of FIG. 4 before the insertion of it, or (3) filling the narrow space between the casing 15 and the dielectric resonator assembly with a cold curable silicon rubber after the insertion of the assembly.

A significant advantage of the multiple-stage dielectric resonance device embodying the invention is that, since the dielectric substrates of the PC boards 16, 17 are lower in thermal conductivity, the preheating is no longer required when the conductive plates 61–64, 71–74 are adhered by soldering or baking techniques to the PC boards 16, 17, thus causing the fixation of the conductive plates to become much easier. In addition, the input/output connectors 10*a*, 10*c* are fixedly attached to the casing 15 enclosing therein the dielectric resonators 5*a*–5*c* and the PC boards 16, 17 with the flange sections of the connectors being tightly sandwiched between the gap-defining wall portions of the casing 15 and the front PC board 16; therefore, any physical stresses being externally applied to the input/output connectors 10, such as bending stresses or torsion stresses, are all transferred to the rigid casing 15 only, rather than to other components including the front PC board 16 and the internal dielectric materials 4*x*, 4*y*(FIG. 1) of each dielectric resonator 5*a*, 5*b* or 5*c*. This ensures that the dielectric resonators 5*a*–5*c* can be free from variations in characteristics as caused by deformations of the PC board upon the application of such external stresses to the input/output connectors 10*a*, 10*c*.

Another advantage of the dielectric resonance device is that, since each of the front and rear PC boards 16, 17 is attached to cover corresponding area-aligned openings 31, 32 (FIG. 1) of the linear array of dielectric resonators 5*a*–5*c*, it becomes possible to enhance the reliability of electrical connections between adjacent ones of the earth conductors 2 on the outer surfaces of the frame bodies 1 of the resonators 5*a*–5*c*, rendering the earth connection more effective. The use of such PC boards can also allow the necessary components to decrease in number causing the device to increase in physical strength while having the manufacturing process simplified.

A further advantage of the dielectric resonance device is that the use of elastic spacers or dampers 23–25 can provide effective suspensions for the dielectric resonators 5*a*–5*c* inside the casing 15. This means that even when shocks are externally applied to the device such shocks can be absorbed successfully by the dampers 23–25 and can be prevented from being transmitted to the internal dielectric materials 4*x*, 4*y*(FIG. 1). It is thus possible to eliminate the occurrence of any damages in the resonators 5*a*–5*c*.

Figure 7:
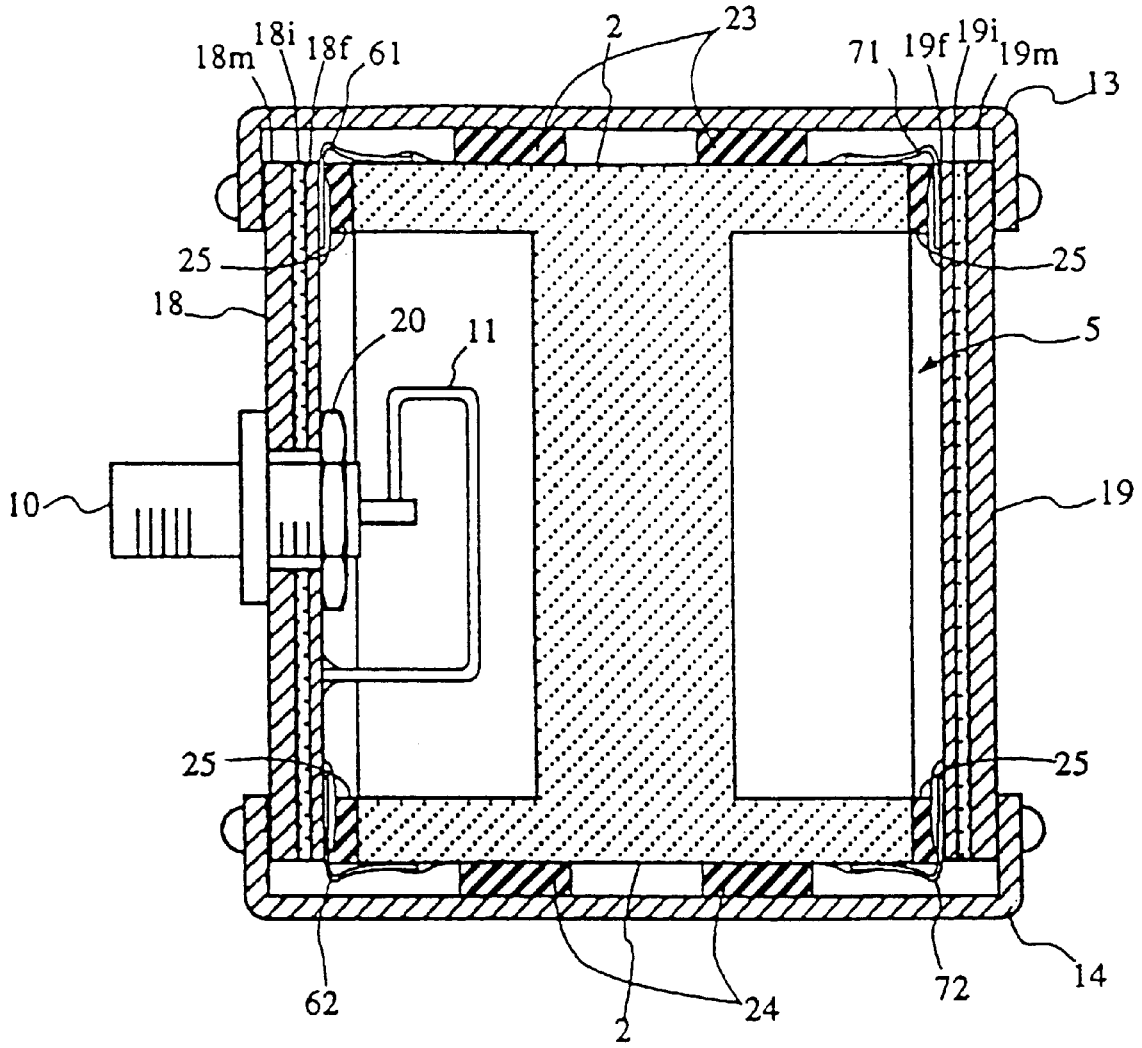
FIG. 7 illustrates in cross-section a dielectric resonance device in accordance with a second embodiment of the invention.
Figure 8:
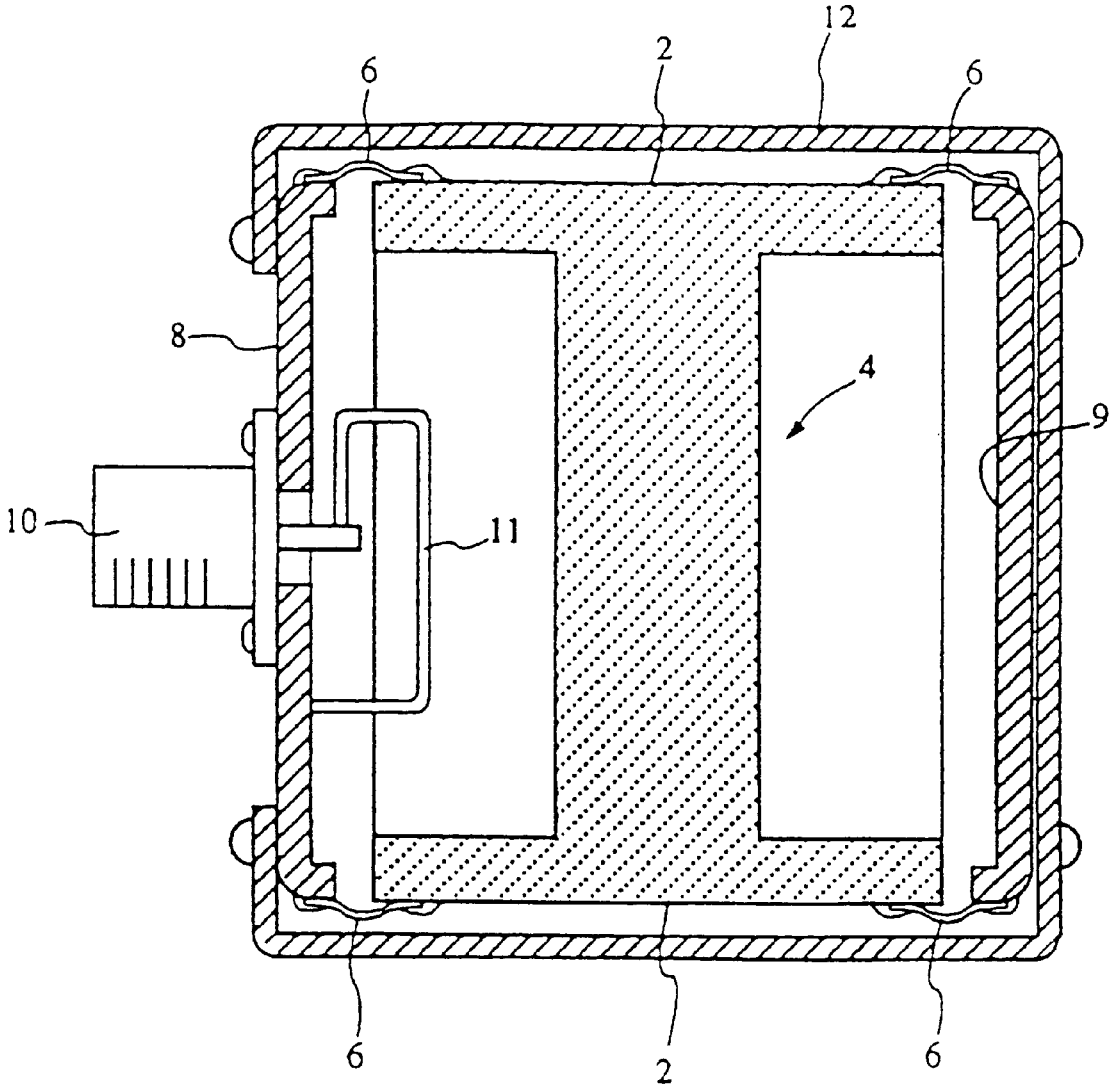
FIG. 8 PRIOR ART
FIG. 8 is a cross-sectional view of a prior art dielectric resonance device.

A dielectric resonance device shown in FIG. 7 in accordance with a second embodiment of the invention is directed to the use of one dielectric resonator 5, the cross-section of which is similar to that of FIG. 6 with the front and rear PC boards 16, 17 being replaced by multi-layered, metal-based PC boards 18, 19 respectively, and the casing 15 being replaced with two separate tray-like casing plates 13, 14.

More specifically, as shown in FIG. 7, the front metal-based PC board 18 has a metal plate 18*m* as its base plate, and a metal film 18*f* laminated across one surface of the plate 18*m* with an insulative layer 18*i* being sandwiched therebetween. Similarly, the rear metal-based PC board 19 has a metal base plate 19*m* and a metal layer 19*f* with an insulative layer 19*i* being disposed therebetween. The metal plates 18*m*, 19*m* may be made of iron, aluminum, or the like. The insulative layer 18*i*, 19*i* may be made of epoxy resin, polyimide resin, etc. The metal films 18*f*, 19*f* may be a copper thin film.

The three-layered PC boards 18, 19 are attached to the front and rear openings 31, 32 (FIG. 1) respectively, with the metal base plates 18*m*, 19*m* facing outward. The conductive plates 61 and 62 are soldered to the metal film 18*f*, whereas the conductive plates 71 and 72 are soldered to the metal film 19*f*. Referring to FIG. 2, conductive plates 63, 64, 73 and 74, which are not shown in FIG. 7, are also soldered to the metal film 18*f* and 19*f* respectively.

The front PC board 18 has several holes that are identical with those of FIG. 3, including a circular hole for attachment of an input/output connector 10 of FIG. 7. This connector 10 is mounted on the front PC board 18 by externally inserting it into the hole of the board 18, and then screwing a nut 20 into the connector 10 so that the connector 10 is tightly fixed to the board 18 with this board being pressed between the nut 20 and the flange section of the input/output connector 10. This connector has a central conductor which is electrically connected by a soldered coupling loop 11 to a selected portion of the metal film 18*f* of the front PC board 18.

The two separate casing plates 13, 14 are attached respectively to the top and bottom portions of the dielectric resonator 5, and are then tightly fixed to the frame body of the resonator 5 by using screws penetrating some holes in the front and rear PC boards 18, 19 and the upstanding side portions of the casing plates 13, 14. The dampers 23, 24, 25 made of silicon rubber are also used in the second embodiment to provide elastic support or suspension for the dielectric resonator 5 in the inner space defined between the casing plates 13, 14 and the front and rear PC boards 18, 19 thus screwed together.

While the second embodiment of FIG. 7 uses only one dielectric resonator 5, it may be modified so that the structure is used for an array of dielectric resonators that are sequentially aligned to provide an elongate dielectric resonator assembly capable of functioning as a multiple-stage dielectric resonance device similar to that shown in FIG. 4.

The dielectric resonance device of FIG. 7 in accordance with the second embodiment of the invention can offer significant advantages similar to those of the previous one. In addition, the use of metal-based PC boards 18, 19 can allow these boards to serve also as a part of the rigid casing structure for the dielectric resonator 5 due to the fact that the boards 18, 19 are fixedly attached by screws to the top and bottom casing plates 13, 14. As a consequence, the physical strength of the resulting dielectric resonance device structure can be maximized by increasing the thickness of such boards 18, 19.

Another advantage of the second embodiment device is that the input/output connector 10 can be mounted directly on the front metal-based PC board 18 thus causing electrical connection to become easier between the outer conductor of the input/output connectors and the metal film of the board 18.

While the invention has been particularly shown and described with reference to preferred embodiments thereof, many other variations and modifications and other uses will become apparent to those skilled in the art, which may be made without departing from the spirit and scope of the invention. Therefore, the present invention is not limited by the specific disclosure herein.

What is claimed is:

1. A method of manufacturing a dielectric resonance device comprising the steps of:

providing a dielectric resonator in a hollow dielectric frame body, a dielectric material in said frame body, and an outer conductor on an outer surface of said frame body, said frame body defining an opening;

providing a conductive plate having a first end and a second end;

conductively coupling said first end of said conductive plate to said outer conductor;

disposing a printed circuit board to cover said opening, with an outer surface of said printed circuit board facing away from said dielectric resonator;

folding a portion of said conductive plate at said second end thereof;

conductively coupling the folded portion of said conductive plate to a peripheral edge on said outer surface of said printed circuit board.

2. The method of claim 1, further comprising the steps of:

providing a casing enclosing said dielectric resonator and said conductive plate, said casing including a rectangular hollow member having a length and a longitudinal gap extending along the length; and providing an input/output connector, said connector having a conductive portion electrically connected to said printed circuit board, said gap in said casing allowing said input/output connector to project outward from said printed circuit board and through said casing.

3. The method of claim 2, further comprising the step of fixing said printed circuit board to said casing.

4. The method of claim 2, further comprising the step of disposing elastic spacers between said casing and said dielectric resonator, for elastically supporting said dielectric resonator inside said casing.

5. The method of claim 4, further comprising the step of disposing additional elastic spacers between said casing and said printed circuit board.

6. The method of claim 1, wherein said frame body defines a pair of opposed openings, including said first-mentioned opening, and further comprising the steps of:

providing a plurality of conductive plates including said first-mentioned conductive plate, each having a first end and a second end, and each said first end being coupled to said outer conductor;

disposing first and second printed circuit boards, including said first-mentioned printed circuit board, to cover the openings respectively, said first and second printed circuit boards having respective outer surfaces facing away from said dielectric resonator;

conductively coupling each of the second ends of said conductive plates to a respective area on the corresponding outer surface of a respective one of said printed circuit boards.

7. The method of claim 6, further comprising the steps of:

providing a casing enclosing said dielectric resonator and said conductive plates, wherein said casing includes a rectangular hollow member having a length and a longitudinal gap extending along the length; and providing an input/output connector, said connector having a conductive portion electrically connected to one of said first and second printed circuit boards, said gap in said casing allowing said input/output connector to project outward from said one printed circuit board and through said casing.

8. The method of claim 7, further comprising the step of fixing said first and second printed circuit boards to said casing.

9. The method of claim 7, further comprising the step of disposing elastic spacers between said casing and said dielectric resonator, for elastically supporting said dielectric resonator inside said casing.

10. The method of claim 9, further comprising the step of disposing additional elastic spacers between said casing and said printed circuit boards.

11. The method of claim 9, further comprising the steps of:

folding respective portions of said plurality of conductive plates at said second ends therof; and fixing said folded portions of said conductive plates to respective peripheral edges of said first and second printed circuit boards.

* * * * *